United States Patent [19]

Anderson et al.

[11] 4,241,545

[45] Dec. 30, 1980

[54] SEPARATING AND UNLOADING DEVICE FOR VIBRATORY FINISHING MACHINES

[75] Inventors: Gordon H. Anderson, Albert Lea; Steven R. Johnson, Hayward, both of Minn.

[73] Assignee: King-Seeley Thermos Co., Prospect Heights, Ill.

[21] Appl. No.: 965,922

[22] Filed: Dec. 4, 1978

[51] Int. Cl.[3] ..... B24B 31/06

[52] U.S. Cl. ..... 51/163.2

[58] Field of Search ..... 51/163.1, 163.2, 7; 241/175

[56] References Cited

U.S. PATENT DOCUMENTS

| | | | |
|---|---|---|---|
| 3,893,266 | 7/1975 | Anderson | 51/163.2 |
| 4,001,979 | 1/1977 | Elkins | 51/163.2 |
| 4,034,520 | 7/1977 | Balz | 51/163.1 |
| 4,042,181 | 8/1977 | Hubert | 51/163.1 |

*Primary Examiner*—Harold D. Whitehead

*Attorney, Agent, or Firm*—Harness, Dickey & Pierce

[57] ABSTRACT

A workpiece separating and unloading device is disclosed for use with vibratory finishing machines of the type comprising a generally circular or annular finishing bowl; the device comprises a generally horizontally disposed workpiece separating screening assembly and a dam or weir which is movably supported so as to be positionable above the level of the finishing media and workpieces within the bowl during a normal finishing operation and being selectively movable to a downward or lower position extending generally transversely of the path of movement of the workpieces and media within the bowl to cause the media-workpiece mixture to be moved onto the upper surface of the separator screen whereby the workpieces are conveyed to some predetermined destination and the finishing media drops downwardly through the separator screen back into the interior of the finishing bowl; the dam or weir is mounted upon a pivot arm which is secured within the central enclosure or dome of the finishing bowl and is pivotable about a generally horizontally disposed axis and concomitantly rotatable about its longitudinal axis as the weir is moved between the aforementioned upper and lower positions.

33 Claims, 7 Drawing Figures

FIG. 1.
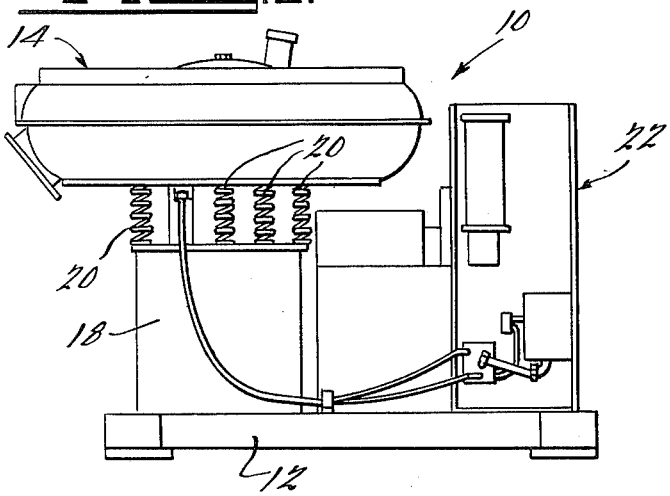
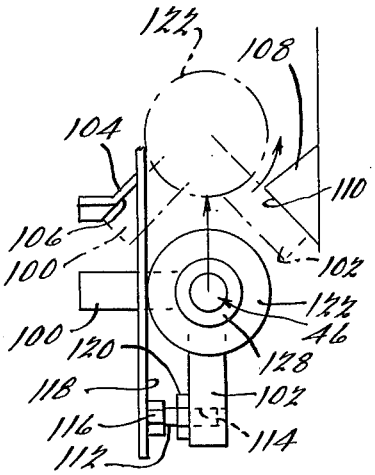
FIG. 5.
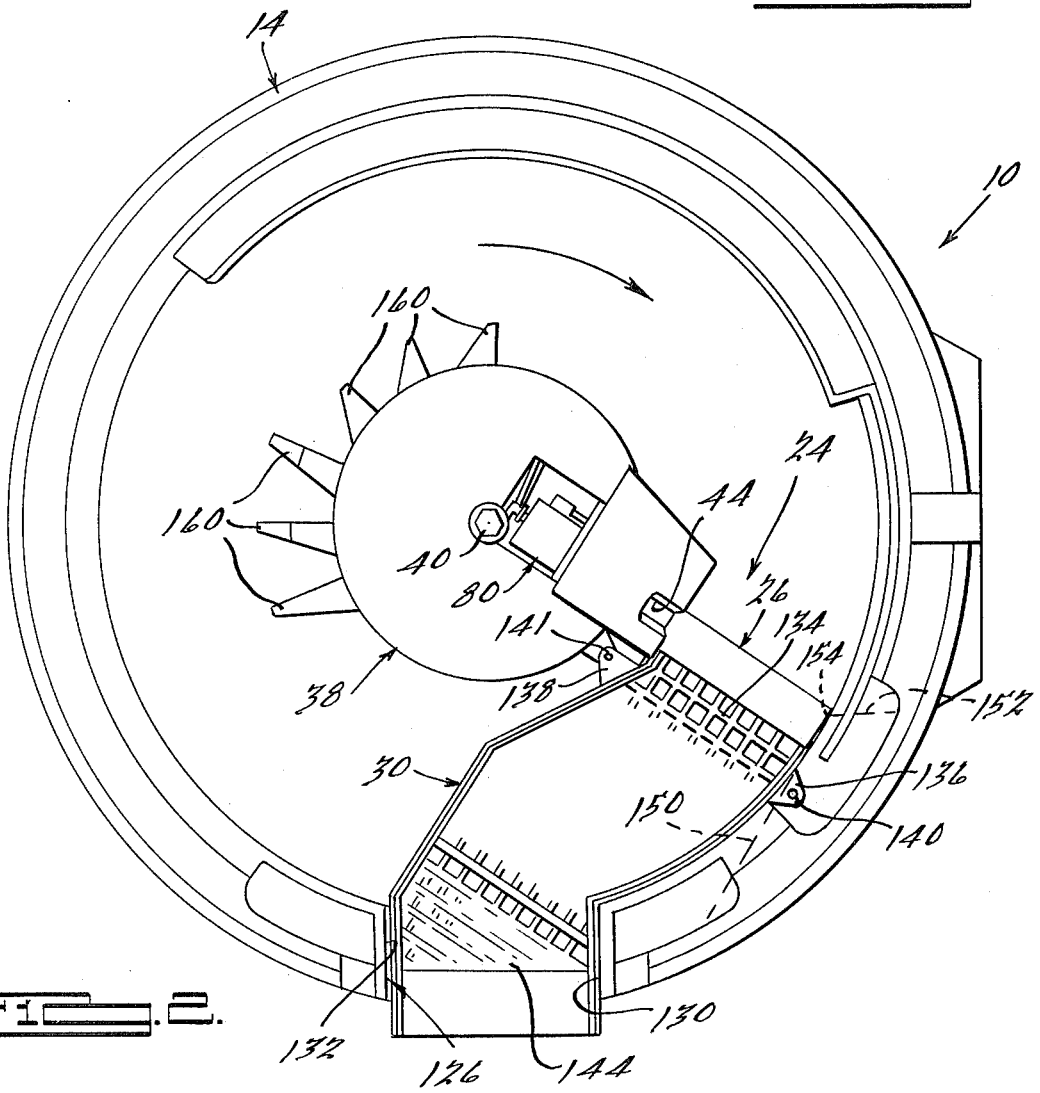
FIG. 2.

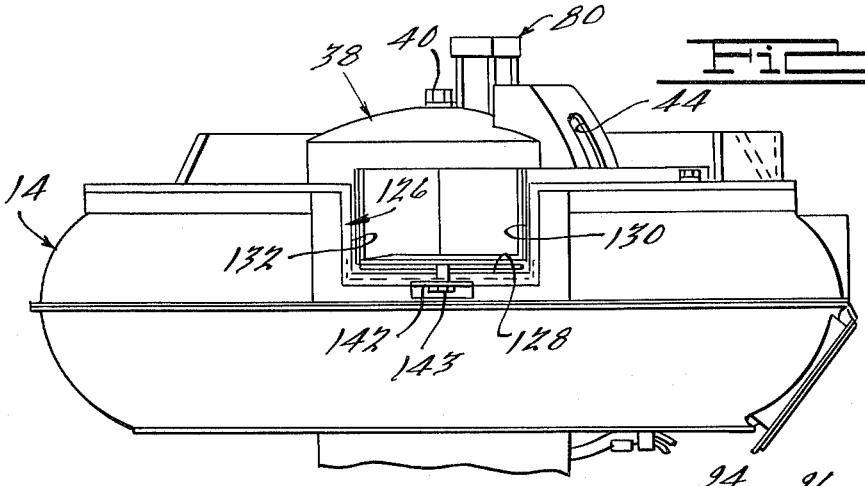
FIG. 3.
FIG. 4.
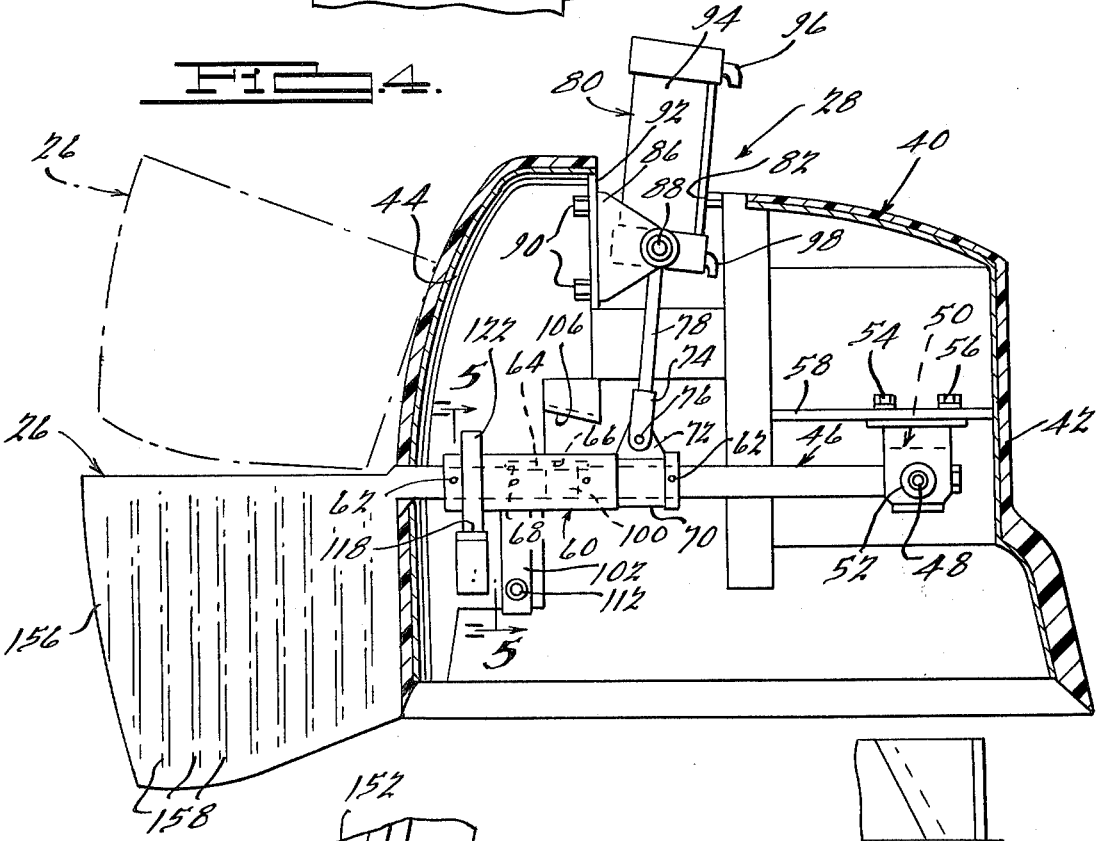
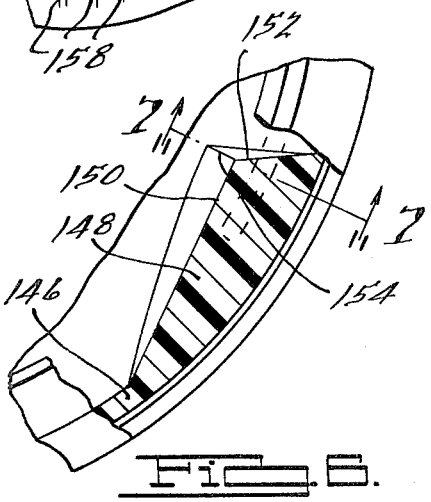
FIG. 6.
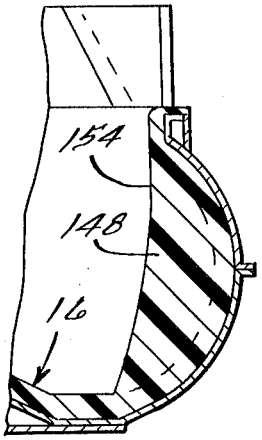
FIG. 7.

SEPARATING AND UNLOADING DEVICE FOR VIBRATORY FINISHING MACHINES

BACKGROUND OF THE INVENTION

The present invention relates generally to vibratory finishing, grinding, polishing and deburring machines of the type which generally comprises annular or toroidal finishing chamber or bowl that is partially filled with a mass of workpieces and finishing media and which is caused to vibrate in a predetermined manner in order to "finish" or debur the workpieces. Such finishing machines are generally shown in U.S. Pat. Nos. 3,100,088; 3,266,739; 3,268,177; 3,161,993 and 3,893,266. More particularly, the present invention relates to a new and improved method and apparatus for separating the workpieces from the media and unloading the workpieces from the finishing bowl in a manner so as to obviate the need for manual handling of the workpieces and/or media.

Heretofore, the separation and removal of finished workpieces from the media in vibratory finishing machines has been accomplished in two generally accepted methods. In one method, the parts and media are conveyed in a generally vertical plane by various types of devices whereby the workpieces and media are deposited on a machine mounted screen or separation purposes, resulting in the media dropping downwardly into the a special chamber adjacent the finishing chamber for the reintroduction into the finishing vessel after the separating cycle. In the second method, the configuration of the finishing compartment is such that the handling of the workpieces and media is in a generally horizontal fashion with the finishing compartment having a spiral or circular ramp arrangement adapted to convey the workpieces and media to a sufficient elevation to make possible installation of the workpiece-from-media separation facility. Neither of these methods, however, has been found to be completely satisfactory insofar as removing and separating workpieces from vibratory finishing machines of the type having circular or bowl-type finishing chambers due to the many difficulties involved in applying or installing the workpiece removing apparatus. Furthermore, in most cases, the unloading apparatus has had to be manually installed and removed at the time each unloading operation was to occur which prevented the machine from being automated so that the workpieces could be removed without an operator being in attendance.

The present invention is intended to overcome the shortcomings of prior known and used workpiece separating and unloading devices and utilizes a novel dam or weir which is mounted by means of a pivot arm secured at a central position within the finishing bowl. The weir and pivot arm are selectively pivotable and rotatable from a first position wherein the weir is located above the surface of the workpiece-media mixture so that the mixture may move around the finishing bowl beneath a generally horizontally disposed separating screen during a normal finishing operation, and a second lower position wherein the weir extends generally transversely of the path of movement of the workpiece-media mixture at a position directly upstream from the separating screen. When the weir is disposed in its lower position, the workpiece-media mixture is caused to move onto the upper surface of the separating screen and the workpieces are conveyed away from the finishing bowl, while the media drops downwardly through the separating screen and is returned to the interior of the finishing bowl. Movement of the weir between the aforesaid elevated or raised and lower positions is achieved through the provision of a piston and cylinder assembly, with the pressure of the workpiece-media mixture acting to selectively rotate the weir to a vertical position as it moves downward toward its unloading position. The entire assembly may be operated without the need for an operator in attendance by properly automating operation of the aforesaid piston and cylinder assembly and by virtue of the extreme simplicity of the design of the weir, its operating mechanism and the associated workpiece separating screen assembly, the apparatus will have a long, effective and maintenance free operational life, as will hereinafter be described in detail.

SUMMARY OF THE INVENTION

The present invention relates generally to a new and improved vibratory finishing machine and more particularly to a workpiece separating and unloading device for use with vibratory finishing machines of the type comprising an annular or circular finishing chamber or bowl.

It is accordingly a general object of the present invention to provide a new and improved vibratory finishing machine.

It is a more particular object of the present invention to provide a separating and unloading device for removing finished workpieces from a vibratory finishing machine at the end of a finishing operation.

It is still a more particular object of the present invention to provide a new and improved workpiece separating and unloading device of the type which comprises a generally horizontally disposed separator screen and a dam or weir which causes workpieces and finishing media to be deposited onto the upper surface of the screen, wherein the workpieces are separated from the media, with the media dropping downwardly through the screen and being returned to the interior of the finishing bowl.

It is still a more particular object of the present invention to provide a workpiece separating and unloading device of the above character wherein the weir is movably supported between a first position disposed above the level of the finishing media and workpieces within the finishing bowl, and a second position extending generally transversely of the direction of movement of the workpieces and media within the bowl.

It is a related object of the present invention to provide a workpiece separating and unloading device, of the above character, wherein the weir is mounted for upward and downward pivotal movement about a generally horizontal axis disposed centrally of the finishing bowl.

It is a related object of the present invention to provide an unloading device wherein the weir rotates concomitantly with upward and downward movement about the aforesaid pivotal axis.

It is another object of the present invention to provide a new and improved workpiece separating and unloading device wherein the weir is movable toward the aforesaid second or lower position under the influence of gravity and the pressure of the workpiece-media mixture moving within the finishing bowl.

It is another object of the present invention to provide a workpiece separating and unloading device for vibratory finishing machines which includes means for positively retaining the weir in its uppermost position during a finishing operation so as to preclude any movement of the weir with respect to the finishing bowl under the influence of the vibratory movement imparted to the bowl to achieve finishing of the workpieces therein.

It is still another object of the present invention to provide a workpiece separating and unloading device of the above described type wherein the weir is fabricated of a relatively soft and deformable material to prevent workpieces from becoming caught between the periphery thereof and the inner periphery of the associated finishing bowl as the weir is moved to its downward or unloading position.

A related object of the present invention resides in the provision of a plurality of ribs or corrugations on the weir to prevent workpieces from adhering thereto, as by surface tension or the like, and a further object of the present invention resides in the provision of a plurality of circumferentially spaced, generally vertically disposed ribs on the central enclosure portion of the finishing bowl to assist workpieces and media moving around the interior thereof during a finishing or unloading operation.

It is still another object of the present invention to provide a new and improved apparatus for separating and unloading workpieces for a vibratory finishing machine which is of a relatively simple design, is inexpensive to manufacture, operate and maintain.

Other objects and advantages of the present invention will become apparent from the following description and appended claims taken in conjunction with the accompanying drawings.

BRIEF DESCRIPTION OF THE DRAWINGS

FIG. 1 is a side elevational view of a vibratory finishing machine in accordance with the principles of the present invention;

FIG. 2 is an enlarged top elevational view of the finishing chamber of the finishing machine shown in FIG. 1;

FIG. 3 is a side elevational view of the finishing chamber of the finishing machine shown in FIGS. 1 and 2;

FIG. 4 is an enlarged fragmentary cross-sectional view of the weir actuating mechanism embodied in the vibratory finishing machine of the present invention;

FIG. 5 is a fragmentary side elevational view of a portion of the weir positioning mechanism embodied in the present invention;

FIG. 6 is an enlarged fragmentary cross-sectional view, partially broken away, of one side portion of the finishing chamber of the present invention; and FIG. 7 is a fragmentary cross-sectional view taken substantially along the line 7—7 of FIG. 6.

DESCRIPTION OF A PREFERRED EMBODIMENT

Referring now in detail to the drawings and in particular to FIG. 1 thereof, a vibratory finishing machine 10, in accordance with one preferred embodiment of the present invention, is shown as generally comprising a horizontally disposed base or support structure 12 upon which a generally toroidal finishing chamber or bowl 14 is mounted. The bowl 14 may be and preferably is provided with an interior lining of a suitable wear resistant material, such as polyurethane, generally designated by the numeral 16. The bowl 14 is adapted to be supported for vibratory movement upon a column-like structure 18 projecting upwardly from the base structure 12 and having a plurality of suitable helical coil springs, generally designated by the numeral 20, interposed between the underside of the bowl 14 and the structure 18. As is well known in the art, the machine 10 is provided with suitable electrical controls 22 which, when properly actuated, complete a control circuit to energize an electrical or hydraulically operated drive motor, which results in vibratory movement of the bowl 14.

Generally speaking, the machine 10 is adapted to be charged or supplied with a multiplicity of workpieces which are to be finished by a finishing media, the bowl 14 being provided with a mass of such finishing media which is intended to act upon the workpieces so as to effect a "finishing", i.e. deburring or other finishing operation, thereon. The vibratory movement which is imparted to the bowl 14 is intended to move the mixture of finishing media and workpieces in a generally orbital path within the bowl 14, which vibratory motion also causes the mixture to travel or progress along a generally circular or circumferential path around the interior of the bowl 14. During the course of the finishing operation, the oribiting motion produces relative movement between the workpieces and the finishing media in order to effect the desired finishing operation. It is to be noted that the term "finishing media" or "material", as used herein, may comprise loose, comminuted, granular or particulate finishing material of the type which is presently employed in the trade. Although certain liquid finishing materials may be used in conjunction with solid finishing materials, these are considered to be ancillary for the purposes of the present invention, which in most cases employs at least some solid finishing media. It is also to be noted that the term "finishing media" or "material", as used herein, pertains to all finishing material which may be used to-effect an abraiding, polishing or other "finishing" operation on the associated workpieces, as will be understood by those in the art.

In accordance with the principles of the present invention, the vibratory finishing machine 10 is provided with a novel workpiece separating and unloading apparatus or device, generally designated by the numeral 24, which is adapted to generally function in selectively removing and conveying the finishing workpieces away from the machine 10 at the completion of a finishing operation and permit the return of the finishing media back to the interior of the bowl 14 for subsequent finishing operations. Generally speaking, the device 24 comprises a weir or dam 26 which is adapted to be selectively positioned in a first or unloading position extending generally transversely of the direction of movement the mixture of media and workpieces within the bowl 14 and which is movable via an actuating assembly, generally designated by the numeral 28, to a second relatively elevated position wherein the lower end of the weir or dam 26 is disposed above the level of the finishing media and workpieces within the bowl 14, which is the position of the weir 26 during the finishing operation. When the weir or dam 26 is disposed in the first mentioned position extending transversely of the direction of movement of the media and workpieces within the bowl 14, the weir 26 acts to cause the finishing media and workpieces to be moved onto the upper surface of a generally horizontally disposed separating screen assembly, generally designated by the numeral 30, where the media and workpieces are separated from one another, with the finished workpieces being conveyed away from the machine 10 and the media dropping downwardly through interstices of the separating screen assembly 30 back into the bowl 14.

As best seen in FIGS. 2 and 3, disposed generally centrally of the bowl 14 is an inverted cup-shaped or dome-like enclosure 38 which is of generally circular shape and is fixedly secured within the bowl 14 by means of a generally vertically extending bolt or similar fastening member 40 which extends downwardly through the center of the enclosure 38 and is threadably engaged with a suitable central portion or cooperable fastening member located interiorly of the bowl 14. The exterior of the enclosure 38 is covered with a suitable material, as is indicated at 42, having the antiwear characteristics of the aforementioned lining 16 of the bowl 14, such as urethane or the like. The enclosure 38 is provided with a generally vertically extending access opening or slot which is generally radially aligned with the weir or dam 26 and has a radially extending pivot arm 46 extending outwardly therethrough. As shown in FIG. 4, the outer end of the arm 46 operatively supports the weir 26, while the inner or opposite end of the arm 46 is provided with a suitable pivot and journal block, generally designated by the numeral 50. The block 50 and hence the inner end of the arm 46 is provided with suitable anti-friction bearing means 52 by which the arm 46 is supported for rotational movement about its longitudinal axis and for relative upward and downward pivotal movement between the solid and phantom lines shown in FIG. 4 about a generally horizontal pivot axis defined by the pivot pin 48. The pivot block 50 is operatively secured by means of suitable screws, bolts or the like 54, 56 to a generally horizontally disposed support plate 58 that is secured as by welding interiorly of the enclosure 38.

Disposed approximately equidistant from the pivot pin 48 and the weir 26 on the pivot arm 46 is an annular collar, generally designated by the numeral 60, which extends coaxially around the pivot arm 46 and is fixedly secured thereto by means of suitable set screws or the like 62. The set screws 62 are intended to prevent relative rotation of the collar 60 with respect to the arm 46, which rotation is further prevented by means of a suitable keyway 64 which is nestingly received within recesses 66 and 68 formed internally of the collar 60 and on the exterior of the arm 46, respectively. The collar 60 is adapted to rotatably carry an annular sleeve-like member 70 at the inner end thereof, with the member 70 being freely rotatable about the longitudinal axis of the collar 60 and arm 46 and being provided with a suitable upwardly extending lug or boss 72 which is connected to a clevis member 74 by means of a suitable connecting pin 76. The clevis member 74 is attached to the lower end of a generally vertically disposed actuating rod 78 of a piston and cylinder assembly, generally designated by the numeral 80, which is mounted within the upper end of the enclosure 38. The assembly 80 may be either single or double acting and extends upwardly through a suitable opening 82 in the upper end of the enclosure 38, as best seen in FIG. 4. The assembly 80 is operatively secured to the enclosure 38 by means of a suitable mounting bracket 86 and a fastening element 88. The bracket 86 is in turn secured via suitable screws, bolts or the like 90 to a generally vertically disposed support plate 94 arranged adjacent and extending downwardly from the opening 82 within the enclosure 38. As is well known in the art, the piston and cylinder assembly 80 includes a cylinder 94 which is adapted to be selectively pressurized, via a suitable source of hydraulic or pneumatic pressure through fittings 96 and/or 98 which are located at the upper and lower ends of the cylinder 94, whereby to cause an actuating piston (not shown) to move upwardly or upwardly and downwardly (depending if the assembly is single or double acting) within the cylinder 94 and effect concomitant vertical movement of the actuating rod 78 which, by virtue of being connected via the clevis member 74 and lug 72 effects pivotal movement of the arm 46 and weir 26 mounted thereon, as will hereinafter be described in detail.

As best seen in FIG. 5, the collar 60 is provided with a pair of outwardly extending arms 100 and 102 which are arranged a generally right angles to one another, with the arm 100 being arranged generally horizontally and the arm 102 being arranged generally vertically when the pivot arm 46 is disposed in the horizontal position shown in FIGS. 4 and 5. The arm 100 is cooperable with a relatively fixed abutment or camming plate 104 defining an upwardly inclined camming surface 106, as seen in FIG. 5, while the arm 102 is cooperable with a stop element 108 defining an abutment surface 110, as seen in this Figure. The arm 102 is provided with an adjustable stop member 112 which may be in the form of a suitable screw, bolt or the like having a head portion 116 engageable with a surface 118, the stop member 112 being threadably received within a suitable bore 114 and having an adjustable jam nut 120 provided thereon for lockingly securing the member 112 in a preselected position with respect to the arm 102. The collar 60 is also provided with a roller member, generally designated by the numeral 122, having anti-friction bearing means 124 which journal supports the member 122 for rotational movement about the axis of the arm 46, the roller member 122 being adapted to roll along the surface 118 as the arm 46 and weir 26 thereon move between the phantom and solid lines shown in FIG. 4, as will hereinafter be described.

With reference to FIG. 5, the arms 100, 102 are disposed in the solid line positions when the weir 26 is in its lower or solid line position shown in FIG. 4; however, at such time as the piston and cylinder assembly 80 is actuated to effect raising of the weir 26 through upward movement of the actuating rod 78 and resulting upward, i.e. clockwise, pivotal movement of the arm 46 in FIG. 4, the arms 100, 102 move upwardly concomitantly with the weir 26. As the arm 100 moves upwardly in FIG. 5, it will engage the camming surface 106 of the abutment plate 104, resulting in the collar 60 and pivot arm 46 rotating in a counterclockwise direction in FIG. 5 which in turn results in counterclockwise rotation of the weir 26 about the axis of the arm 46. Such rotational movement of the collar 60, pivot arm 46 and weir 26 will continue as the arm 46 is biased upwardly under the influence of the actuated piston and cylinder assembly 80 until such time as the arm 102 engages the surface 110 of the stop element 108 which occurs when the pivot arm 46 is disposed in its upper or elevated position. The magnitude of the rotational movement of the arm 46 and weir 26 mounted thereon is in the order of approximately 45 degrees, which results in the lower or bottom portion of the weir 26 being raised above the level of the finishing media and workpieces within the bowl 14 to an even greater degree than would occur through mere upward pivotal movement of the arm 46 upon actuation of the piston and cylinder assembly 80, whereby to assure that the workpieces and finishing media may progress around the bowl 14 during a normal finishing operation without such movement being impaired by the weir 26. At such time as it is desired to effect an unloading or separating operation upon the workpieces and finishing media, the piston and cylinder assembly 80 may be either deactuated to permit downward movement of the actuating rod 78 and downward pivotal movement of the weir 26 from the phantom line position in FIG. 4 to the solid line position shown in this Figure under the influence of gravity, or alternatively, the assembly 80 may be actuated to cause such downward movement of the weir 26 under fluid pressure. As the arm 46 moves downwardly, the lower end of the weir 26 will move into the mass of finishing media and workpieces moving around the bowl 14 and due to the rotational movement of such mass of media and workpieces, the arm 46 will be pivoted in a generally clockwise direction in FIG. 5 until such time as the weir 26 assumes a generally vertical orientation within the bowl 14, with further clockwise rotational movement of the weir 26 and pivot arm 46 being precluded as the stop member 112 engages the surface 118 which results in positive vertical positioning of the weir 26 during the unloading operation.

As best seen in FIG. 2, the side of the finishing bowl 14 adjacent the outlet end of the separating screen assembly 30 is formed with an outlet or discharge opening, generally designated by the numeral 126. The opening is generally rectangular in shape and includes a bottom or horizontal edge portion 128 and a pair of spaced apart generally vertically disposed side portions 130, 132. As shown in FIG. 2, the separating screen assembly 30 extends generally horizontally between one side of the weir 26 and the opening 126, with the upstream end of the assembly 30, generally designated by the numeral 134, being provided with a pair of generally horizontally outwardly extending lugs 138, 140 which are secured by suitable screws, bolts or the like to the finishing bowl 14. Directly below the side edge portion 128 of the opening 126, the bowl 14 is provided with a generally outwardly extending mounting lug 142 which is secured via a fastening element 143 to the downstream end 144 of the separating screen assembly 30, with the result that after workpieces move over the upper edge of the weir 26, they will progress along the assembly 30 under the influence of the vibratory movement of the bowl 14 toward the outlet or downstream end 144 thereof where the same may be transferred to a suitable conveyor mechanism, or other suitable destination.

The lining material 16 of the finishing bowl 14 is of generally uniform thickness, as seen at 146 in FIG. 6, with the exception of an enlarged thickness portion 148 thereof which is located directly in radial alignment with the weir 26. As shown in FIG. 6, the portion 148 includes inwardly inclined surfaces 150, 152 which terminate at an apex 154 which is located in the general plane of the weir 26 when the same is disposed in its lower or unloading position. The purpose of the enlarged thickness portion 148 of the lining material 16 is to fill in the area between the radially outer edge of the weir 26 and the concave peripheral side of the bowl 14 so as to prevent media and workpieces from traveling around the outer periphery or edge of the weir 26 and so as to permit the weir 26 to move upwardly and downwardly without interference with the upper edge of the bowl 14. A secondary purpose of the enlarged thickness portion 148 is to assure that the level of the media downstream from the weir 26 is sufficiently low to prevent workpieces from engaging the underside of the separating screen assembly 30 and thereby permit the assembly 30 to be left permanently mounted upon the finishing machine 10 of the present invention. The lower media level is achieved by virtue of the fact that the cross sectional area of the bowl 14 increases significantly directly downstream from the enlarged thickness portion 148 to assure that the upper level of the media is located below the underside of the separating screen assembly 30. The weir 26 itself, as previously mentioned, is molded from a suitable wear resistant material, such as urethane, which is of a relatively soft durometer so that it will be relatively flexible, particularly the side edges 156 thereof, whereby to prevent workpieces from lodging or being caught between the outer edge of the weir 26 and the interior of the bowl 14 as the weir 26 is moved to the unloading (lower) position. As shown in FIG. 4, the upstream side of the weir 26 is provided with a plurality of spaced parallel vertical corrugation or ribs, generally designated by the numeral 158, in order to assure that relatively flat or planar workpieces will not adhere to the surface of the weir 26 by surface tension or the like.

As shown in FIG. 2, the outer periphery of the enclosure 38 is provided with a plurality of circumferentially spaced, radially outwardly extending, vertically disposed ribs which are formed integrally of the covering material 42 thereon. The purpose of the ribs 160 is to assist movement of the workpieces and media around the interior of the bowl 14 toward the weir 26.

Referring now in detail to the overall operation of the vibratory finishing machine 10 of the present invention, assuming that the bowl 14 contains a mixture of workpieces and finishing media and that the weir 26 is disposed in the raised position shown in phantom lines in FIG. 4, and further assuming that the machine 10 is energized to effect vibratory movement of the workpiece-media mixture within the bowl 14 and thus movement thereof in the direction of the arrow in FIG. 2 around the interior of the bowl 14, the finishing media will perform a finishing operation on the workpieces as the media-workpiece mixture moves around the bowl 14. At such time as the finishing operation is completed, or for some other reason it is desired to separate the workpieces from the finishing media, the piston and cylinder assembly 80 is actuated, whereupon the weir 26 will move downwardly under the influence of fluid pressure or gravity from the phantom line position shown in FIG. 4 toward the solid line position shown in this Figure. As the lower end or edge of the weir 26 moves into the workpiece-media mixture, the pressure of the mixture against the weir causes the same to rotate toward a vertical position, which position is achieved when the stop member 112 engages the surface 118, as previously mentioned. When the weir 26 is in its downward position shown by solid lines in FIG. 4, the workpiece-media mixture will move toward and into engagement with the weir 26 which will in turn cause the mixture moving around the bowl 14 to flow over the top of the weir 26 onto the upper surface of the separating screen assembly 30 instead of passing therebelow which occurs when the weir 26 is in its raised position. As the media-workpiece mixture moves onto the upper surface of the screen assembly 30, the vibratory movement imparted to the assembly 30 due to vibratory motion of the bowl 14 will cause the workpieces to be moved along or across the upper surface of the assembly 30 toward the discharge end 144 thereof while the finishing media will drop downwardly through the interstices in the assembly 30 to be returned to the interior of the bowl 14. After all of the workpieces have been removed or discharged from the machine 10, the piston and cylinder assembly 80 may again be actuated, resulting in upward movement of the actuating rod 78 and concomitant upward pivotal movement and rotation of the arm 46 and weir 26 mounted on the radially outer end thereof.

A particular feature of the present invention resides in the fact that the arms 100, 102 and their cooperative abutment plate 104 and stop element 108 positively secure the pivot arm 46 and weir 26 in their respective upper position which is essential to prevent vibration of the arm 46 and weir 26 due to vibratory movement of the bowl 14. The weir 26 will be thus maintained in its upper or raised position during the subsequent finishing operation, after which the piston and cylinder assembly 80 may again be actuated to permit lowering of the weir 26 and pivot arm 46 for a subsequent separating or discharge operation, as previously described.

While it will be apparent that the preferred embodiment of the present invention disclosed herein is well calculated to fulfill the objects above stated, it will be appreciated that the invention is susceptible to modification, variation and change without departing from the scope or fair meaning of the subjoined claims.

We claim:

1. In combination with a vibratory finishing machine comprising a generally circular finishing chamber adapted to be subjected to vibratory movement whereby workpieces and finishing media move about a generally circular path during a finishing operation, a workpiece separating and unloading device including a weir element arranged generally transversely of said path of movement of the workpiece-media mixture within the chamber, means supporting said element for upward and downward pivotal movement about a generally horizontal pivotal axis, whereby said weir may be moved into and out of said path of workpiece and media movement, said last mentioned means comprising a pivot arm secured to said weir and extending generally radially of said finishing chamber, and means disposed generally centrally of said finishing chamber for supporting said shaft for pivotal movement about said horizontal pivotal axis for rotational movement about the axis of said shaft.

2. The invention as set forth in claim 1 which includes a generally horizontally disposed workpiece-media separating screen disposed adjacent said weir element.

3. The invention as set forth in claim 1 wherein said pivot arm has said inner end thereof pivotably and rotatably mounted generally centrally of said finishing chamber, and which includes actuating means for raising said pivot arm and said weir to a position wherein said weir is out of said path of workpiece and media movement.

4. The invention as set forth in claim 3 wherein said actuating means comprises pressure operated piston and cylinder means and which includes camming means for rotating said weir element about the longitudinal axis about said pivot arm.

5. The invention as set forth in claim 4 which includes retaining means for resisting movement of said pivot arm and said weir element with respect to said finishing chamber when said pivot arm and said weir element are disposed in a raised position.

6. The invention as set forth in claim 5 wherein said retaining means includes said camming means.

7. The invention as set forth in claim 4 wherein said piston and cylinder means comprises an actuating rod and which includes collar means rotatably connecting said actuating rod to said pivot arm.

8. The invention as set forth in claim 7 wherein said camming means comprises first and second elements extending radially outwardly from said pivot arm and fixedly connected thereto and engageable with fixed abutment members when said pivot arm is disposed in a raised position.

9. A vibratory finishing machine comprising, a finishing tub having generally concentrically oriented circular inner and outer walls and defining an annular finishing chamber adapted to receive finishing media and workpieces to be finished, a discharge area in said outer wall and a generally horizontally disposed separating element having an outlet end portion communicable with said discharge area, weir means disposed adjacent said separating element, and means supporting said weir at a first position arranged generally transversely of said chamber and for pivotal and rotational movement between said first position and a second position arranged above workpieces and media within said chamber, said last mentioned means comprising a pivot arm secured to said weir and extending generally radially of said finishing chamber, with one radial end of said arm being mounted for pivotal and rotational movement.

10. The invention as set forth in claim 9 wherein said one radial end of said arm is disposed adjacent said inner wall of said chamber.

11. The invention as set forth in claim 10 wherein said inner wall of said chamber is defined by a generally dome-shaped enclosure having a generally vertically disposed slot formed therein, and wherein said pivot arm extends outwardly through said slot.

12. The invention as set forth in claim 11 which includes means for rotating said pivot arm upon movement of said weir means toward said second position.

13. The invention as set forth in claim 11 which includes power operated means for raising said pivot arm to a location wherein said weir means is disposed in said second position.

14. The invention as set forth in claim 13 which includes an outwardly extending element on said pivot arm, said element being cooperable with fixedly mounted means within said enclosure for causing said pivot arm and said weir mounted thereon to rotate about the longitudinal axis of said pivot arm upon upward movement of said pivot arm.

15. The invention as set forth in claim 13 wherein said power operated means comprises an actuating rod, wherein said pivot arm has a collar member rotatable thereon, and which includes means operatively connecting said actuating rod to said collar means.

16. The invention as set forth in claim 9 wherein said weir means is fabricated from a moldable and relatively deformable material.

17. The invention as set forth in claim 16 wherein said weir is formed with a plurality of outwardly projecting ribs to prevent workpieces from adhering thereto.

18. The invention as set forth in claim 9 wherein said finishing tub includes a wear resistant lining material.

19. The invention as set forth in claim 18 wherein said lining material on said inner wall defines a plurality of circumferentially spaced, vertically extending ribs which assist workpieces and media to move around said chamber during vibratory movement of said tub.

20. The invention as set forth in claim 9 wherein the cross sectional size of said chamber is reduced directly upstream from said separating element.

21. The invention as set forth in claim 20 wherein the reduced cross sectional size of said chamber is provided by an enlarged thickness portion of a lining material provided around the interior of said chamber.

22. An unloading apparatus for a vibratory finishing machine including a finishing bowl having a generally circular finishing compartment with radially inner and outer walls and an unloading area adapated to receive finishing media and workpieces, said apparatus including a generally vertically oriented weir adapted to be movably disposed within said compartment and cause the media and workpieces moving around the compartment to be moved toward said unloading area, and an operating mechanism disposed generally centrally of said compartment comprising a pivot arm secured to said weir and comprising the sole means for supporting the same for movement about a generally horizontal axis and also about an axis colinear with the axis of said arm generally arcuate path away from the workpieces and media moving around said compartment.

23. The invention as set forth in claim 22 which includes a generally dome-shaped enclosure located centrally of said compartment and having a vertically disposed opening formed therein, said pivot arm extending outwardly through said opening, with one end of said arm disposed within said enclosure and being pivotably and rotatably secured therein.

24. The invention as set forth in claim 23 which includes means for rotating said pivot arm upon movement of said weir means.

25. The invention as set forth in claim 23 which includes power operated means for raising said pivot arm to a location wherein said weir means is disposed above workpieces and media within said compartment.

26. The invention as set forth in claim 23 which includes an outwardly extending element on said pivot arm, said element being cooperable with fixedly mounted means within said enclosure for causing said pivot arm and said weir mounted thereon to rotate about the longitudinal axis of said pivot arm upon upward movement of said pivot arm.

27. The invention as set forth in claim 25 wherein said power operated means comprises an actuating rod, wherein said pivot arm has a collar member rotatable thereon, and which includes means operatively connecting said actuating rod to said collar means.

28. The invention as set forth in claim 22 wherein said weir means is fabricated from a molded relatively deformable material.

29. The invention as set forth in claim 28 wherein said weir is formed with a plurality of outwardly projecting ribs to prevent workpieces from adhering thereto.

30. The invention as set forth in claim 22 wherein said finishing compartment includes a wear resistant lining material.

31. The invention as set forth in claim 30 wherein said lining material defines a plurality of circumferentially spaced vertically extending ribs which assist workpieces and media to move around said chamber during vibratory movement of said compartment.

32. The invention as set forth in claim 22 wherein the cross sectional size of said compartment is reduced adjacent said weir.

33. The invention as set forth in claim 32 wherein the reduced cross sectional size of said compartment is provided by an enlarged thickness portion of a lining material provided around the interior thereof.

* * * * *

UNITED STATES PATENT AND TRADEMARK OFFICE

CERTIFICATE OF CORRECTION

PATENT NO. : 4,241,545

DATED : December 30, 1980

INVENTOR(S) : Gordon H. Anderson et al

It is certified that error appears in the above-identified patent and that said Letters Patent are hereby corrected as shown below:

Column 6, line 16, "a" should be --at--. Column 10, line 51, (Claim 14) "13" should be --11--. Column 11, line 19, (Claim 22) "adapated" should be --adapted--.

Signed and Sealed this

*Twenty-sixth* Day of *May 1981*

[SEAL]

*Attest:*

RENE D. TEGTMEYER

*Attesting Officer* *Acting Commissioner of Patents and Trademarks*